US011703773B2

(12) United States Patent
Nishida et al.

(10) Patent No.: US 11,703,773 B2
(45) Date of Patent: Jul. 18, 2023

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tsutomu Nishida, Shizuoka (JP); Yuka Ishiduka, Shizuoka (JP); Tatsuya Ohsawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/680,115

(22) Filed: Feb. 24, 2022

(65) Prior Publication Data

US 2022/0276576 A1 Sep. 1, 2022

(30) Foreign Application Priority Data

Mar. 1, 2021 (JP) ..... 2021-032147

(51) Int. Cl.

| | |
|---|---|
| ***G03G 15/00*** | (2006.01) |
| ***G03G 5/05*** | (2006.01) |
| ***G03G 15/08*** | (2006.01) |
| ***G03G 5/147*** | (2006.01) |

(52) U.S. Cl.
CPC ..... *G03G 5/05* (2013.01); *G03G 5/147* (2013.01); *G03G 15/0865* (2013.01)

(58) Field of Classification Search
CPC ..... G03G 5/05; G03G 15/00; G03G 15/147; G03G 15/0865
USPC ..... 399/107, 110, 111, 116
See application file for complete search history.

(56) References Cited

U.S. PATENT DOCUMENTS

| | | | | |
|---|---|---|---|---|
| 10,691,033 | B2 * | 6/2020 | Nishida | G03G 5/14708 |
| 10,747,131 | B2 * | 8/2020 | Watanabe | G03G 15/0147 |

FOREIGN PATENT DOCUMENTS

| | | | |
|---|---|---|---|
| JP | 2002031904 | * | 1/2002 |
| JP | 2008070665 | * | 7/2008 |
| JP | 2012008440 | A | 1/2012 |
| JP | 2020095236 | A | 6/2020 |

* cited by examiner

*Primary Examiner* — Hoan H Tran
(74) *Attorney, Agent, or Firm* — Canon U.S.A., Inc., IP Division

(57) ABSTRACT

An electrophotographic photosensitive member that is excellent in image smearing resistance and low torque while maintaining its electrophotographic characteristic. The electrophotographic photosensitive member is an electrophotographic photosensitive member including, in this order: a support; a photosensitive layer; and a protection layer as a surface layer, wherein the protection layer has a surface having a developed area ratio Sdr of 1.0% to 40.0%, and wherein an A value represented by the following formula (1) is 0.10 to 0.27: A=S1/S2 . . . formula (1), where, in the formula (1), S1 represents a peak area based on C═C stretching vibration of an aromatic ring by attenuated total reflection Fourier transform infrared spectroscopy, and S2 represents a peak area based on C═O stretching vibration of an ester group by the same method.

19 Claims, 1 Drawing Sheet

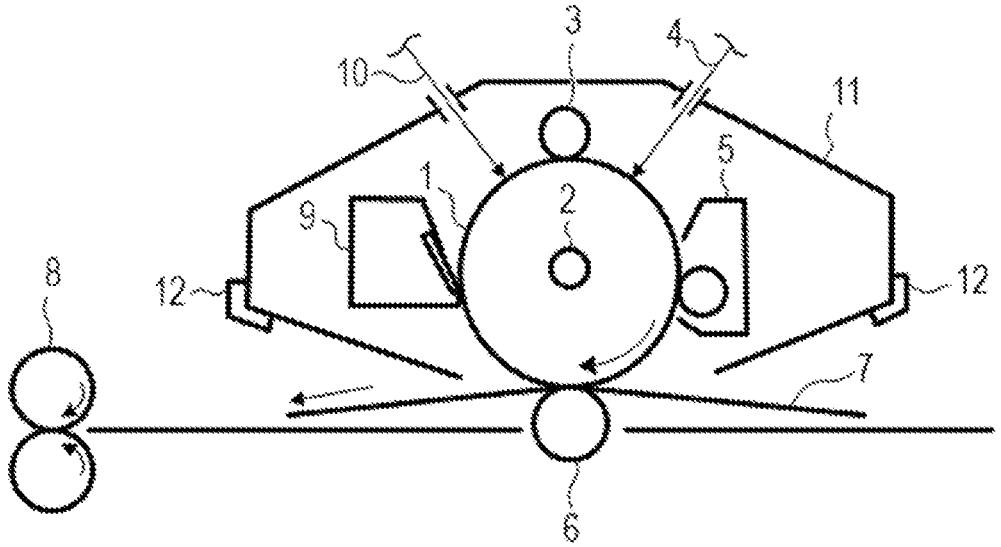
3
4
10
11
5
1
2
9
8
12
12
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and to a process cartridge and an electrophotographic apparatus each including the electrophotographic photosensitive member.

Description of the Related Art

A wide variety of investigations have heretofore been made on an electrophotographic photosensitive member to be mounted on an electrophotographic apparatus for improving its image quality and durability. An example of the investigations is an investigation in which a radical-polymerizable resin is used in the surface of the electrophotographic photosensitive member to improve its abrasion resistance (mechanical durability). Meanwhile, image smearing has occurred as a detrimental effect due to the improvement in abrasion resistance in some cases. The image smearing is a phenomenon in which an output image blurs owing to the blurring of an electrostatic latent image. The phenomenon is considered to be caused by a change in surface resistance of the surface of the electrophotographic photosensitive member under a high-humidity environment due to the remaining of a discharge product produced by charging on the surface of the electrophotographic photosensitive member.

In Japanese Patent Application Laid-Open No. 2012-8440, there is a description of a technology in which the surface layer of an electrophotographic photosensitive member is formed by polymerizing a polymerizable compound having 7 or more and 10 or less radical-polymerizable functional groups, and having a reactive group equivalent (molecular weight/number of functional groups) of 140 or less and 100 or more, and hence the surface layer is excellent in scratch resistance, abrasion resistance, and crack resistance. In addition, in Japanese Patent Application Laid-Open No. 2020-95236, there is a description of a technology in which the protection layer of an electrophotographic photosensitive member contains fluorine resin particles and a partially fluorinated alcohol-substituted glycol in addition to a radical-polymerizable resin, and hence suppresses image smearing.

According to an investigation by the inventors of the present disclosure, in the electrophotographic photosensitive member as described in Japanese Patent Application Laid-Open No. 2012-8440 or Japanese Patent Application Laid-Open No. 2020-95236, it may be impossible to sufficiently achieve both of image smearing resistance and low torque while maintaining its electrophotographic characteristic (hereinafter also referred to as "sensitivity"), and hence the achievement thereof has been a disadvantage.

SUMMARY OF THE INVENTION

Accordingly, an aspect of the present disclosure is to provide an electrophotographic photosensitive member that is excellent in image smearing resistance and low torque while maintaining its electrophotographic characteristic.

The aspect is achieved by the present disclosure described below. That is, an electrophotographic photosensitive member according to the present disclosure is an electrophotographic photosensitive member comprising, in this order: a support; a photosensitive layer; and a protection layer as a surface layer, wherein the protection layer has a surface having developed area ratio Sdr of 1.0% to 40.0%, and an A value represented by the following formula (1) of 0.10 to 0.27:

$$A = S1/S2 \qquad \text{formula (1)}$$

wherein, in the formula (1), S1 represents a peak area from 1,530 $cm^{-1}$ to 1,470 $cm^{-1}$ based on C═C stretching vibration of an aromatic ring out of peak areas of a spectrum obtained by subjecting the surface of the protection layer to measurement by a Fourier transform infrared spectroscopy total reflection method through use of Ge as an internal reflection element and through use of a measurement condition of 45° as an angle of incidence, and S2 represents a peak area from 1,770 $cm^{-1}$ to 1,700 $cm^{-1}$ based on C═O stretching vibration of an ester group out of the peak areas of the spectrum obtained by subjecting the surface of the protection layer to the measurement by the Fourier transform infrared spectroscopy total reflection method through use of Ge as the internal reflection element and through use of a measurement condition of 45° as the angle of incidence.

According to the present disclosure, the electrophotographic photosensitive member that is excellent in image smearing resistance and low torque while maintaining its electrophotographic characteristic can be provided.

Further features of the present disclosure will become apparent from the following description of exemplary embodiments with reference to the attached drawing.

BRIEF DESCRIPTION OF THE DRAWINGS

FIGURE an illustration of an example of the schematic configuration of an electrophotographic apparatus of the present disclosure.

DESCRIPTION OF THE EMBODIMENTS

The present disclosure is described in detail below by way of an exemplary embodiment.

An electrophotographic photosensitive member (hereinafter sometimes referred to as "photosensitive member") according to one aspect of the present disclosure is an electrophotographic photosensitive member comprising, in this order: a support; a photosensitive layer; and a protection layer serving as a surface layer, the photosensitive layer and the protection layer being arranged in the stated order on the support, wherein a surface of the protection layer has a developed area ratio Sdr of 1.0% to 40.0%, and wherein an A value represented by the following formula (1) is 0.10 to 0.27. Further, the A value is more preferably 0.12 to 0.16.

$$A = S1/S2 \qquad \text{formula (1)}$$

In the formula (1), S1 represents a peak area from 1,530 $cm^{-1}$ to 1,470 $cm^{-1}$ based on C═C stretching vibration of an aromatic ring out of peak areas of a spectrum obtained by subjecting the surface of the protection layer to measurement by a Fourier transform infrared spectroscopy total reflection method through use of Ge as an internal reflection element and through use of a measurement condition of 45° as an angle of incidence, and S2 represents a peak area from 1,770 $cm^{-1}$ to 1,700 $cm^{-1}$ based on C═O stretching vibration of an ester group out of the peak areas of the spectrum obtained by subjecting the surface of the protection layer to the measurement by the Fourier transform infrared spectroscopy total reflection method through use of Ge as the internal reflection element and through use of a measurement condition of 45° as the angle of incidence.

The developed area ratio Sdr represents the area ratio at which the developed area (surface area) of a defined region increases with respect to the area of the defined region. When the Sdr is set within the range of from 1.0% to 40.0%, the pressurization of a contact member against the photosensitive member per unit surface area can be reduced, and hence low torque can be achieved. In addition, when the surface area is increased, it becomes easier to remove a discharge product, which occurs at the time of discharge and adheres to the surface of the photosensitive member, with the contact member. The inventors of the present disclosure have assumed that this is because an area of contact between the contact member and the surface of the photosensitive member was able to be increased while the pressurization of the contact member against the photosensitive member was reduced. Further, the inventors have found that when the ratio A value of the peak area based on the C═C stretching vibration of the aromatic ring to the peak area based on the C═O stretching vibration of the ester group of the surface of the photosensitive member is set to 0.10 to 0.27 at the time of the removal of the discharge product at low torque, it becomes easier to remove the discharge product. The inventors have assumed that this is because the adhesive property of the discharge product to the C═O of the ester group and that to the C═C of the aromatic ring are different from each other, and hence when the ratio falls within the range, the removal of the discharge product from the surface of the photosensitive member reduced in torque by the increase in surface area can be effectively achieved.

When the Sdr is less than 1.0%, an improvement in ability to remove the discharge product by the increase in area of contact may not be observed, and when the Sdr is more than 40.0%, the roughness of the surface of the photosensitive member may be large to preclude sufficient removal of the discharge product with the contact member. In addition, the C═C of the aromatic ring tends to have a carrier transporting ability in the protection layer larger than that of the C═O of the ester group. When the A value is less than 0.10, the carrier transporting ability in the protection layer cannot be sufficiently secured, and hence the electrophotographic characteristic of the photosensitive member reduces in some cases. Meanwhile, the adhesive property of the discharge product to the C═C of the aromatic ring tends to be larger than that to the C═O of the ester group. When the A value is more than 0.27, the protection layer and the discharge product may strongly adhere to each other to preclude sufficient removal of the discharge product.

In addition, in the present disclosure, it is preferred that the surface of the protection layer has a B value represented by the following formula (2) of 0.005 to 0.070.

$$B = S3/S2 \qquad \text{formula (2)}$$

In the formula (2), S2 is identical in meaning to the S2 in the formula (1), and represents the peak area based on the C═O stretching vibration of the ester group, and S3 represents a peak area from 1,413 $cm^{-1}$ to 1,400 $cm^{-1}$ based on in-plane deformation vibration of a terminal olefin ($CH_2$═) out of the peak areas of the spectrum obtained by subjecting the surface of the protection layer to the measurement by the Fourier transform infrared spectroscopy total reflection method through use of Ge as the internal reflection element and through use of a measurement condition of 45° as the angle of incidence.

It is assumed that when the peak area based on the in-plane deformation vibration of the terminal olefin having a π bond and showing hydrophilicity is controlled within the range defined as described above with respect to the peak area based on the C═O stretching vibration of the ester group, the penetration of moisture into the protection layer is reduced, and hence an increase in torque due to its moisture absorption can be suppressed.

The aromatic ring, the ester group, and the terminal olefin in the protection layer may each be incorporated into any material for forming the protection layer. For example, when the protection layer contains the cured product of a composition containing a monomer having a polymerizable functional group, and the cured product contains the aromatic ring, the ester group, and the terminal olefin, the aromatic ring, the ester group, and the terminal olefin in the protection layer may not be derived from the monomer having a polymerizable functional group. When the aromatic ring, the ester group, and the terminal olefin are present in the protection layer even after long-term use of the photosensitive member, and hence the A value and the B value do not change, the aromatic ring, the ester group, and the terminal olefin may not be incorporated into a polymer including a structure derived from the monomer having a polymerizable functional group.

In addition, it is preferred that the protection layer comprises an unsubstituted cyclohexane skeleton and/or a cyclohexane skeleton having a substituent. The presence of a three-dimensional molecular structure may be able to effectively remove the discharge product.

It is preferred that the protection layer comprise a triarylamine compound which is free of a curable functional group, in a content of 5 mass % to 50 mass % with respect to the total mass of the protection layer. The electrophotographic characteristic can be improved while the function of the protection layer is maintained.

It is preferred that the protection layer comprises electroconductive particles in content of 5 mass % to 30 mass % with respect to the total mass of the protection layer, and the electroconductive particles be particles of at least one kind selected from the group consisting of: indium tin oxide; aluminum oxide; zirconium oxide; zinc oxide; indium oxide; lanthanum oxide; and tin antimony oxide. This is effective in maintaining the Sdr value within a preferred range over endurance.

As described in the foregoing mechanism, when the respective configurations synergistically affect each other, the effects of the present disclosure can be achieved.

[Electrophotographic Photosensitive Member]

The electrophotographic photosensitive member of the present disclosure is characterized by including the photosensitive layer and the protection layer.

A method of producing the electrophotographic photosensitive member of the present disclosure is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

The respective layers are described below.

<Support>

In the present disclosure, the electrophotographic photosensitive member includes the support. In the present disclosure, the support is preferably an electroconductive support having electroconductivity. In addition, examples of the shape of the support include a cylindrical shape, a belt shape, and a sheet shape. A support having a cylindrical shape out of those shapes is preferred. In addition, the surface of the support may be subjected to, for example, electrochemical treatment such as anodization, blast treatment, or cutting treatment.

A metal, a resin, glass, or the like is preferred as a material for the support.

Examples of the metal include aluminum, iron, nickel, copper, gold, stainless steel, and alloys thereof. An aluminum support using aluminum out of those metals is preferred.

In addition, electroconductivity may be imparted to the resin or the glass through treatment involving, for example, mixing or coating the resin or the glass with an electroconductive material.

<Electroconductive Layer>

In the present disclosure, an electroconductive layer may be arranged on the support. The arrangement of the electroconductive layer can conceal a flaw and unevenness on the surface of the support, and can control the reflection of light on the surface of the support.

The electroconductive layer preferably contains electroconductive particles and a resin.

A material for the electroconductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, the metal oxide is preferably used as the electroconductive particles. In particular, titanium oxide, tin oxide, or zinc oxide is more preferably used.

When the metal oxide is used as the electroconductive particles, the surface of the metal oxide may be treated with a silane coupling agent or the like, or the metal oxide may be doped with an element, such as phosphorus or aluminum, or an oxide thereof.

In addition, the electroconductive particles may each be of a laminated configuration including a core particle and a covering layer covering the core particle. A material for the core particle is, for example, titanium oxide, barium sulfate, or zinc oxide. A material for the covering layer is, for example, a metal oxide such as tin oxide.

In addition, when the metal oxide is used as the electroconductive particles, the volume-average particle diameter of the particles is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain, for example, a concealing agent, such as a silicone oil, resin particles, or titanium oxide.

The average thickness of the electroconductive layer is preferably 1 μm or more and 50 μm or less, particularly preferably 3 μm or more and 40 μm or less.

The electroconductive layer may be formed by: preparing a coating liquid for an electroconductive layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent. A dispersion method for the dispersion of the electroconductive particles in the coating liquid for an electroconductive layer is, for example, a method involving using a paint shaker, a sand mill, a ball mill, or a liquid collision-type high-speed dispersing machine.

<Undercoat Layer>

In the present disclosure, an undercoat layer may be arranged on the support or the electroconductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron transporting material, a metal oxide, a metal, an electroconductive polymer, and the like for the purpose of improving electric characteristics. Of those, an electron transporting material and a metal oxide are preferably used.

Examples of the electron transporting material include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting material having a polymerizable functional group may be used as the electron transporting material and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer may be formed by: preparing a coating liquid for an undercoat layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, an ester-based solvent, and an aromatic hydrocarbon-based solvent.

<Photosensitive Layer>

In the present disclosure, the photosensitive layer is arranged on the support, the electroconductive layer, or the undercoat layer. The photosensitive layer of the electrophotographic photosensitive member is mainly classified into (1) a laminate type photosensitive layer and (2) a monolayer type photosensitive layer. (1) The laminate type photosensitive layer includes a charge generating layer containing a charge generating material and a charge transporting layer containing a charge transporting material. (2) The monolayer type photosensitive layer includes a photosensitive layer containing both of the charge generating material and the charge transporting material.

(1) Laminate Type Photosensitive Layer

The laminate type photosensitive layer includes the charge generating layer and the charge transporting layer.

(1-1) Charge Generating Layer

The charge generating layer preferably contains the charge generating material and a resin.

Examples of the charge generating material include an azo pigment, a perylene pigment, a polycyclic quinone pigment, an indigo pigment, and a phthalocyanine pigment. Of those, an azo pigment and a phthalocyanine pigment are preferred. Of the phthalocyanine pigments, an oxytitanium phthalocyanine pigment, a chlorogallium phthalocyanine pigment, and a hydroxygallium phthalocyanine pigment are preferred.

The content of the charge generating material in the charge generating layer is preferably 40 mass % or more and 85 mass % or less, more preferably 60 mass % or more and 80 mass % or less with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge generating layer is preferably 0.1 μm or more and 1 μm or less, more preferably 0.15 μm or more and 0.4 μm or less.

The charge generating layer may be formed by: preparing a coating liquid for a charge generating layer containing the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent.

(1-2) Charge Transporting Layer

The charge transporting layer preferably contains the charge transporting material and a resin.

Examples of the charge transporting material include a polycyclic aromatic compound, a heterocyclic compound, a hydrazone compound, a styryl compound, an enamine compound, a benzidine compound, a triarylamine compound, and a resin having a group derived from any of those materials. Of those, a triarylamine compound and a benzidine compound are preferred.

Compounds represented by the formula (CTM-1) to the formula (CTM-11) are given below as examples of a compound that may be suitably used as the charge transporting material.

(CTM-1)

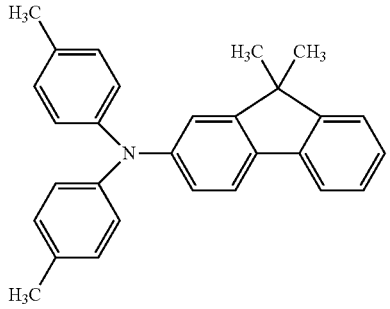

(CTM-2)

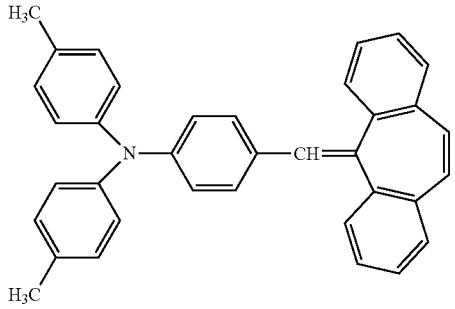

(CTM-3)

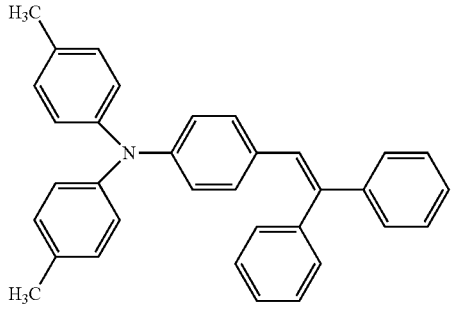

(CTM-4)

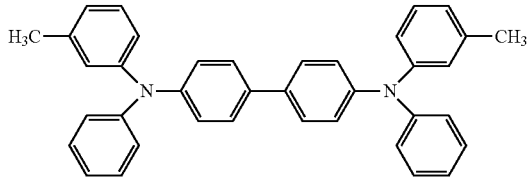

-continued
(CTM-5)
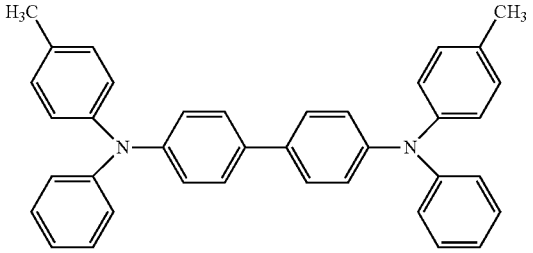
(CTM-6)
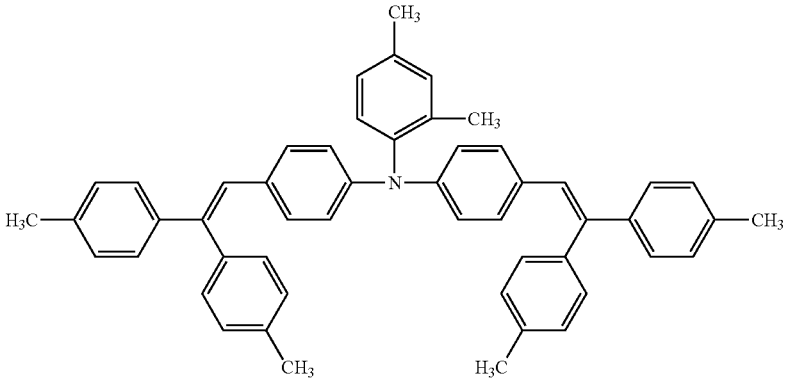
(CTM-7)
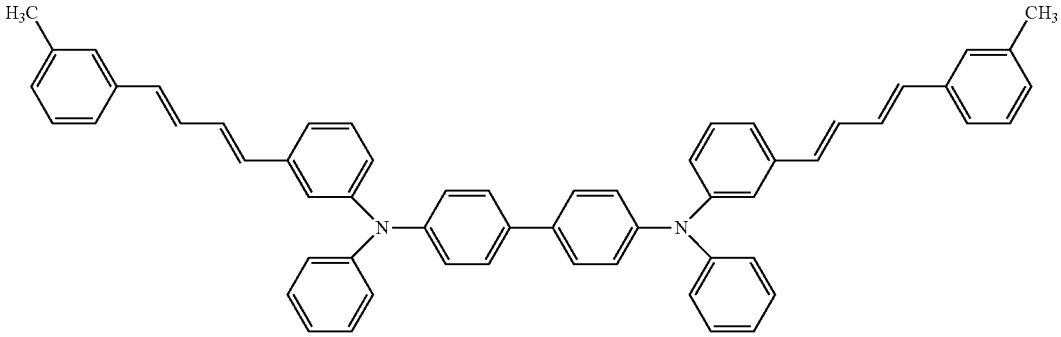
(CTM-8)
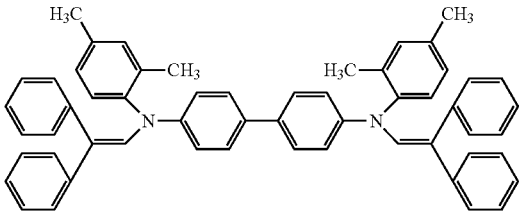
(CTM-9)
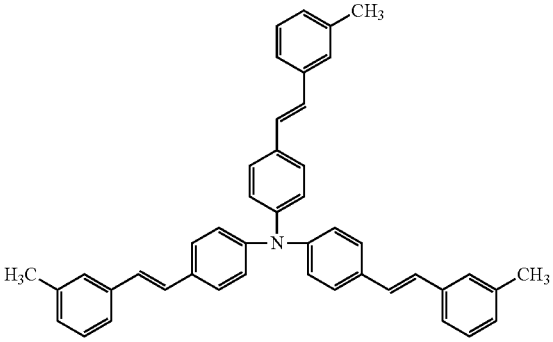

-continued (CTM-10)

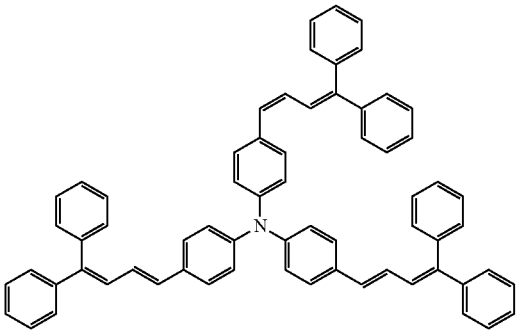

m + n = 0, 1, 2, = 1:2:1

(CTM-11)

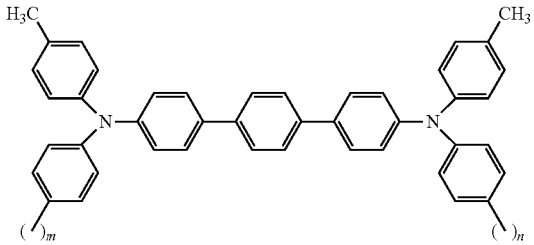

The content of the charge transporting material in the charge transporting layer is preferably 25 mass % or more and 70 mass % or less, more preferably 30 mass % or more and 55 mass % or less with respect to the total mass of the charge transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge transporting material and the resin is preferably from 4:10 to 20:10, more preferably from 5:10 to 12:10.

In addition, the charge transporting layer may contain an additive, such as an antioxidant, a UV absorber, a plasticizer, a leveling agent, a slipperiness-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge transporting layer is preferably 5 μm or more and 50 μm or less, more preferably 8 μm or more and 40 μm or less, particularly preferably 10 μm or more and 30 μm or less.

The charge transporting layer may be formed by: preparing a coating liquid for a charge transporting layer containing the above-mentioned respective materials and a solvent; forming a coating film of the coating liquid; and drying the coating film. Examples of the solvent to be used in the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Monolayer Type Photosensitive Layer

The monolayer type photosensitive layer may be formed by: preparing a coating liquid for a photosensitive layer containing the charge generating material, the charge transporting material, a resin, and a solvent; forming a coating film of the coating liquid; and drying the coating film. The charge generating material, the charge transporting material, and the resin are the same as the examples of the materials in the above-mentioned section "(1) Laminate Type Photosensitive Layer".

<Protection Layer>

In the present disclosure, the protection layer serving as the surface layer is arranged on the photosensitive layer. The protection layer is formed from a composition having an aromatic ring and an ester group.

The protection layer is preferably formed as a cured film by polymerizing a composition containing a monomer having a polymerizable functional group. A reaction at that time is, for example, a thermal polymerization reaction, a photopolymerization reaction, or a radiation polymerization reaction. Examples of the polymerizable functional group of the monomer having a polymerizable functional group include an acrylic group and a methacrylic group. A material having a charge transporting ability may be used as the monomer having a polymerizable functional group. An example of the monomer having a polymerizable functional group is a compound represented by the following formula (Acr-1):

(Acr-1)

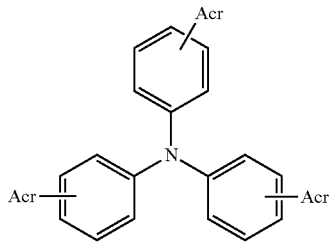

where Acr represents an acrylic group or methacrylic group that may have a substituent.

Further, specific examples thereof include compounds represented by the following formulae (Acr-11) to (Acr-13).

(Acr-11)

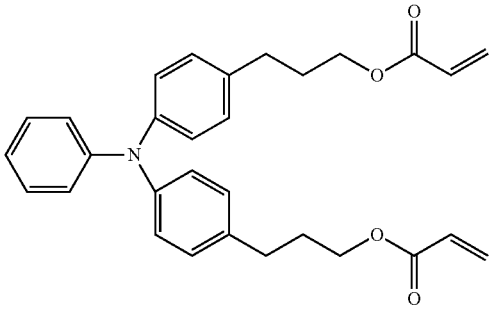

(Acr-12)

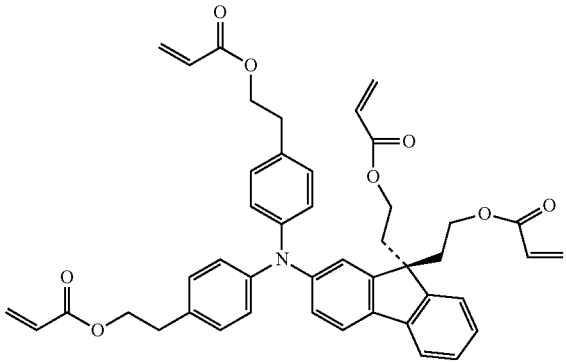

-continued (Acr-13)

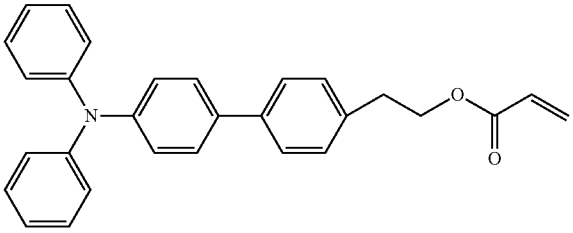

In addition, an example of such a monomer that the protection layer is free of the skeleton of the charge transporting material is a compound represented by the following formula (Acr-2):

(Acr-2)

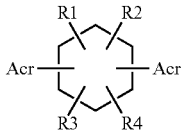

where Acr represents an acrylic group or methacrylic group that may have a substituent, and R1 to R4 each represent a hydrogen atom or a methyl group.

Further, specific examples thereof include compounds represented by the following formulae (Acr-21) to (Acr-23).

(Acr-21)

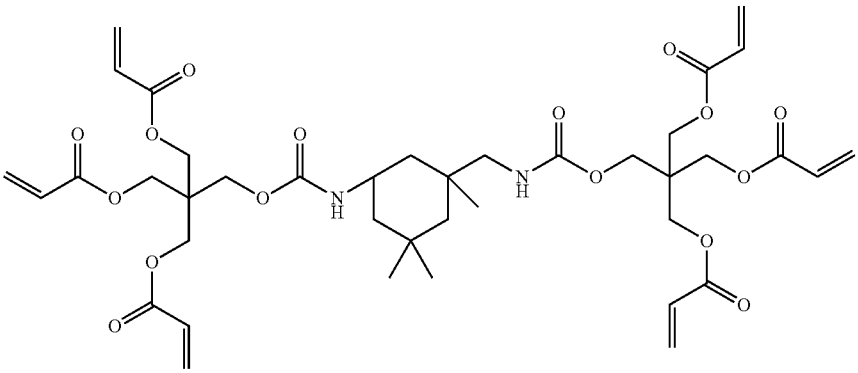

(Acr-22)

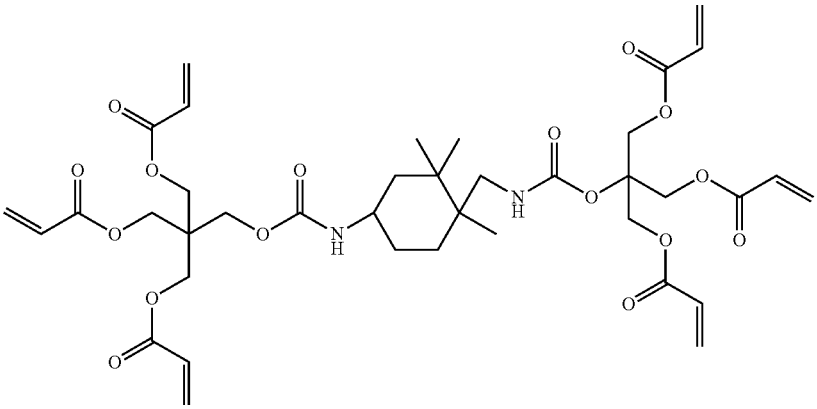

-continued (Acr-23)

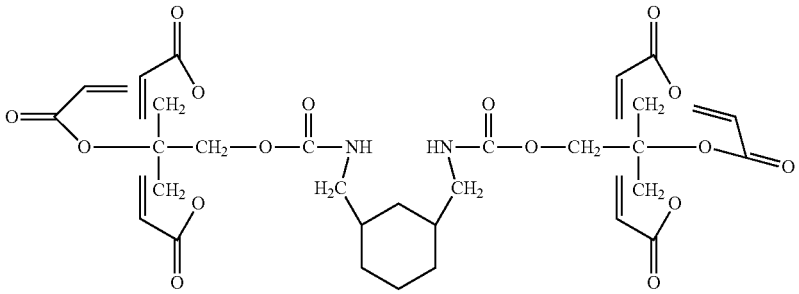

A photopolymerization initiator may be used for obtaining the cured film through the polymerization of the composition by the photopolymerization reaction. Examples of the photopolymerization initiator include 1-hydroxycyclohexyl phenyl ketone (P-1) and phenylbis(2,4,6-trimethylbenzoyl)phosphine oxide (P-2) shown below.

(P-1)

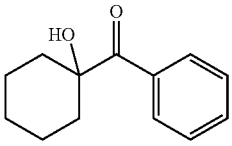

(P-2)

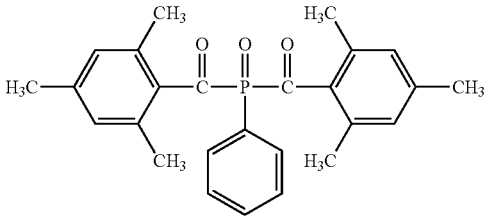

The protection layer may contain an additive, such as a charge transporting material, an antioxidant, a UV absorber, a plasticizer, a leveling agent, a slipperiness-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, and electroconductive particles.

A case in which the siloxane-modified resin has an unsubstituted cyclohexane skeleton and/or a cyclohexane skeleton having a substituent is preferred.

The charge transporting material to be used in the charge transporting layer may be used as the charge transporting material of the protection layer. In addition, for example, charge transporting materials represented by the following formulae (CTM-21) to (CTM-26) may each be used.

(CTM-21)

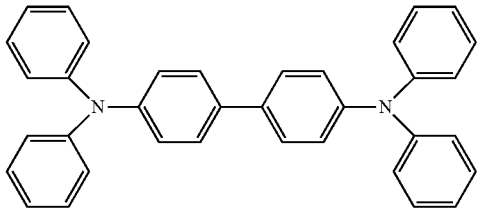

(CTM-22)

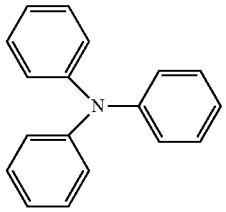

(CTM-23)

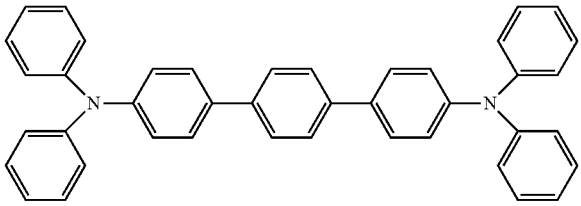

(CTM-24)

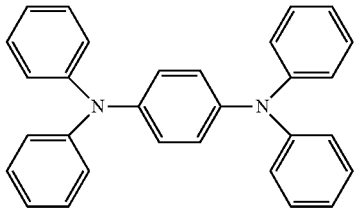

(CTM-25)

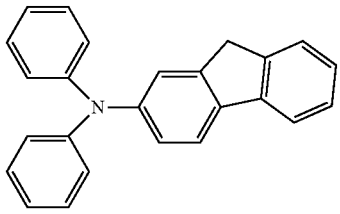

-continued (CTM-26)

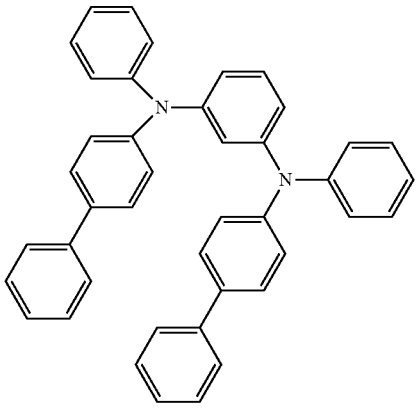

(CTM-27)

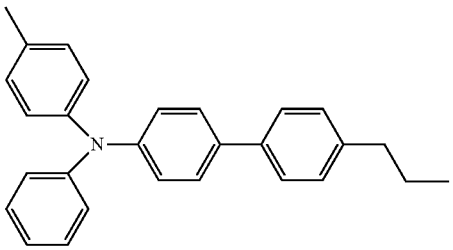

Examples of the electroconductive particles include indium tin oxide, aluminum oxide, zirconium oxide, zinc oxide, indium oxide, lanthanum oxide, and tin antimony oxide, and the particle diameter D90 thereof is preferably 400 nm or less. When the particle diameter D90 is 400 nm or more, the ability to remove the discharge product may reduce.

The particle diameter D90 was measured as described below. A liquid module was attached to a laser diffraction-type particle size distribution-measuring device "LS-230" (manufactured by Beckman Coulter, Inc.), and the D90 of the particles was calculated from the particle size distribution thereof on a volume basis obtained with the device. The measurement was performed as described below. About 10 mg of the particles were added to 10 ml of methanol, and were dispersed therein with an ultrasonic wave dispersing machine for 2 minutes. After that, the dispersion liquid was subjected to the measurement under the conditions of a measurement time of 90 seconds and a number of times of measurement of 1.

The average thickness of the protection layer is preferably 0.5 μm or more and 10 μm or less, more preferably 1 μm or more and 7 μm or less.

The protection layer may be formed by: preparing a coating liquid for a protection layer containing the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, a sulfoxide-based solvent, an ester-based solvent, an aromatic hydrocarbon-based solvent, and an alicyclic saturated hydrocarbon-based solvent.

[Process Cartridge and Electrophotographic Apparatus]

A process cartridge of the present disclosure is characterized in that the process cartridge integrally supports the electrophotographic photosensitive member described above, and at least one unit selected from the group consisting of: a charging unit; a developing unit; a transferring unit; and a cleaning unit, and is removably mounted onto the main body of an electrophotographic apparatus.

It is preferred that the cleaning unit comprises a cleaning blade, and having a surface having a dynamic hardness of 0.06 to 0.60 ($mN/\mu m^2$). When the dynamic hardness falls within the range, the discharge product can be effectively removed while low torque is maintained.

In addition, an electrophotographic apparatus of the present disclosure is characterized by including the electrophotographic photosensitive member described above, a charging unit, an exposing unit, a developing unit, and a transferring unit.

It is preferred that the transferring unit comprises an intermediate transfer member having a surface layer comprising an acrylic resin. In addition, it is preferred that the peripheral speed ratio of the peripheral speed D2 of the intermediate transfer member to the peripheral speed D1 of the electrophotographic photosensitive member fall within a range represented by the following formula (4). With this configuration, the discharge product can be effectively removed.

$$101\% \leq D2/D1 \leq 120\% \quad \text{formula (4)}$$

It is preferred that the developing unit comprise a developer-carrying member, and the peripheral speed ratio of the peripheral speed D3 of the developer-carrying member to the peripheral speed D1 of the electrophotographic photosensitive member fall within a range represented by the following formula (5). When the ratio falls within the range, the discharge product can be effectively removed while low torque is maintained.

$$80\% \leq D3/D1 \leq 120\% \quad \text{formula (5)}$$

It is preferred that the electrophotographic apparatus further comprises a lubricant-supplying unit for supplying a lubricant to the surface of the electrophotographic photosensitive member, and the lubricant-supplying unit holding the lubricant. With this configuration, the discharge product can be effectively removed while low torque is maintained.

An example of the schematic construction of an electrophotographic apparatus including a process cartridge including an electrophotographic photosensitive member is illustrated in FIGURE.

An electrophotographic photosensitive member 1 having a cylindrical shape is rotationally driven about a shaft 2 in an arrow direction at a predetermined peripheral speed. The surface of the electrophotographic photosensitive member 1 is charged to a predetermined positive or negative potential by a charging unit 3. Although a roller charging system based on a roller type charging member is illustrated in FIGURE, a charging system, such as a corona charging system, a proximity charging system, or an injection charging system, may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit such as the toner remaining on the surface of the electrophotographic photosensitive member 1 after the transfer. In addition, a so-called cleaner-less system for removing the deposit with the developing unit or the like without separate arrangement of the cleaning unit may be used. The electrophotographic apparatus may include an electricity-removing mechanism for subjecting the surface of the electrophotographic photosensitive member 1 to electricity-removing treatment with pre-exposure light 10 from a pre-exposing unit (not shown). In addition, a guiding unit 12 such as a rail may be arranged for removably mounting a process cartridge 11 of the present disclosure onto the main body of an electrophotographic apparatus.

The electrophotographic photosensitive member of the present disclosure may be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description of the following Examples, "part(s)" is by mass unless otherwise specified.

<Production of Electrophotographic Photosensitive Member>

Method of Producing [Photosensitive Member 1]

Support

An aluminum tube having a wall thickness of 1 mm, a length of 257 mm, and a diameter of 24 mm whose surface had been subjected to mirror finishing was subjected to degreasing in a solution, which had been obtained by dissolving 30 g of a degreasing agent (manufactured by KIZAI Corporation, product name: NG-#30) in 1 l of water, at 60° C. for 5 minutes. Next, the tube was washed with water, was immersed in 6% nitric acid at 25° C. for 1 minute, and was further washed with water. The tube was subjected to anodization treatment in a 180 g/l sulfuric acid electrolyte solution (dissolved aluminum ion concentration: 7 g/l) at a current density of 0.8 A/dm$^2$ so that an anodized film having an average thickness of 4.5 μm was formed thereon. Next, the tube was washed with water, and was then subjected to sealing treatment by being immersed in an aqueous solution, which had been obtained by dissolving 10 g of a high-temperature sealing agent (manufactured by Okuno Chemical Industries Co., Ltd., product name: TOP SEAL DX-500) containing nickel acetate as a main component in 1 l of water, at 95° C. for 30 minutes. Further, the tube was subjected to ultrasonic cleaning treatment and dried. The dried product was used as an electroconductive support.

Charge Generating Layer

Next, 10 parts of a polyvinyl butyral resin (product name: S-LEC BX-1, manufactured by Sekisui Chemical Co., Ltd.) was dissolved in 600 parts of cyclohexanone. 15 Parts of an oxytitanium phthalocyanine crystal of a crystal form having a strong peak at a Bragg angle 2θ±0.2° of 27.3° in its CuKα characteristic X-ray diffraction was added as a charge generating material to the solution. The mixture was loaded into a sand mill using glass beads each having a diameter of 1 mm, and was subjected to dispersion treatment for 4 hours. After that, 600 parts of ethyl acetate was added to the dispersion liquid to prepare a coating liquid for a charge generating layer. The coating liquid for a charge generating layer was applied onto the support by dip coating, and the resultant coating film was dried for 15 minutes at 80° C. to form a charge generating layer having a thickness of 0.20 μm.

Charge Transporting Layer

Next, 60 parts of the compound (charge transporting material) represented by the formula (CTM-11), and 75 parts of a biphenyl copolymerization-type polycarbonate resin (weight-average molecular weight: 30,000) having a structural unit represented by (Binder-1) and a structural unit represented by (Binder-2) at a mass ratio of 9:1 were dissolved in a mixed solvent of 340 parts of toluene and 200 parts of tetrahydrofuran to prepare a coating liquid for a charge transporting layer.

(Binder-1)

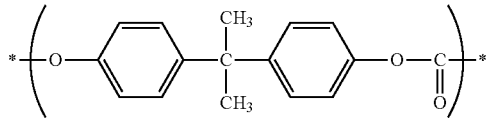

(Binder-2)

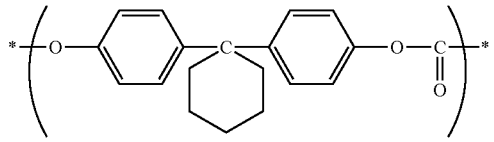

The coating liquid for a charge transporting layer was applied onto the charge generating layer by dip coating to form a coating film, and the resultant coating film was dried for 60 minutes at 120° C. to form a charge transporting layer having a thickness of 25.5 μm.

Protection Layer

Next, the following materials were prepared.

Compound represented by the formula (Acr-11) as an OCL monomer 1 50 parts

Compound represented by the formula (Acr-21) as an OCL monomer 2 50 parts

Compound represented by the formula (P-1) as a polymerization initiator 5 parts

Those materials were mixed with a mixed solvent of 360 parts of 2-propanol and 40 parts of tetrahydrofuran, and the mixture was stirred. Thus, a coating liquid for a protection layer was prepared.

The coating liquid for a protection layer was applied onto the charge transporting layer by dip coating to form a coating film, and the resultant coating film was dried for 6 minutes at 50° C. After that, under the air, an electrodeless lamp H BULB (manufactured by Heraeus K.K.) was used to apply UV light to the coating film under the condition of a lamp intensity of 0.7 W/cm$^2$ for 20 seconds while the support (irradiation target body) was rotated at a speed of 300 rpm. Next, heating treatment was performed under such a condition that the temperature of the coating film became 120° C. for 1 hour. Thus, a protection layer having a thickness of 3 μm was formed. Thus, a cylindrical (drum-shaped) electrophotographic photosensitive member before surface roughening treatment including the protection layer to be used in Example 1 was produced.

Surface Roughening Treatment for Protection Layer

Next, the surface of the protection layer was polished to be roughened. A polishing sheet (product name: C-2000, manufactured by Fuji Photo Film Co., Ltd., substrate: polyester film (thickness: 75 μm)) was used. Specifically, the surface roughening was performed for 30 seconds at a feeding speed of the polishing sheet of 220 mm/sec, a number of revolutions of the electrophotographic photosensitive member of 40 rpm, and a pressing pressure of 3 $N/m^2$ while the polishing sheet and the electrophotographic photosensitive member were rotated in directions counter to each other. Thus, a photosensitive member 1 was obtained.

Surface Analysis of Photosensitive Member

<Measurement of A Value and B Value>

The infrared spectroscopic spectrum of the surface (surface of the protection layer) of the resultant electrophotographic photosensitive member was measured by using a Fourier transform infrared spectroscopy total reflection method under the following conditions. Thus, the A value and B value of the photosensitive member were determined. The S1 was defined as a peak area from 1,530 $cm^{-1}$ to 1,470 $cm^{-1}$, the S2 was defined as a peak area from 1,770 $cm^{-1}$ to 1,700 $cm^{-1}$, and the S3 was defined as a peak area from 1,413 $cm^{-1}$ to 1,400 $cm^{-1}$.

An average obtained as follows was used as each of the A value and the B value: measurement was performed at four points in the peripheral direction of the photosensitive member at each of positions distant from both the end portions of the photosensitive member in its shaft direction by 50 cm each and the center thereof in the shaft direction; and the measured values were averaged.

$$A = S1/S2$$

$$B = S3/S2$$

(Measurement Conditions)

Apparatus: FT/IR-420 (manufactured by JASCO Corporation)

Accessories: ATR device

Internal reflection element (IRE): Ge

Angle of incidence: 45 degrees

Number of scans: 32

<Measurement of Sdr>

The surface of the resultant electrophotographic photosensitive member was observed with a laser microscope (manufactured by Keyence Corporation, product name: VK-9500) including a 50× magnification lens in an enlarged manner, and the Sdr value of an uneven portion arranged on the surface of the electrophotographic photosensitive member was measured. At the time of the observation, adjustment was performed so that no tilt was present in the longitudinal direction of the electrophotographic photosensitive member, and in the peripheral direction, the apex of the arc of the electrophotographic photosensitive member was brought into focus, followed by the determination of the Sdr value.

An average obtained as follows was used as the Sdr value: the measurement was performed at four points in the peripheral direction at each of the positions distant from both the end portions of the photosensitive member in the shaft direction by 50 cm each and the center thereof in the shaft direction; and the measured values were averaged.

Methods of Producing [Photosensitive Member 2] to [Photosensitive Member 23] and [Comparative Photosensitive Member 1] to [Comparative Photosensitive Member 6]

In the method of producing the [photosensitive member 1], the materials for the protection layer and the polishing sheet were changed as shown in Table 1 below. A [photosensitive member 2] to a [photosensitive member 23] and a [comparative photosensitive member 1] to a [comparative photosensitive member 6] were produced and analyzed in the same manner as in the method of producing the [photosensitive member 1] except the foregoing.

TABLE 1

| | OCL monomer 1 | | OCL monomer 2 | | Poly-merization initiator | | Triarylamine compound free of curable functional group | |
|---|---|---|---|---|---|---|---|---|
| Photosensitive member | Material | Number of parts | Material | Number of parts | Material | Number of parts | Material | Number of parts |
| Photosensitive member 1 | (Acr-11) | 50 parts | (Acr-21) | 50 parts | (P-1) | 5 parts | None | — |
| Photosensitive member 2 | (Acr-11) | 25 parts | (Acr-21) | 75 parts | (P-1) | 5 parts | None | — |
| Photosensitive member 3 | (Acr-12) | 25 parts | (Acr-21) | 75 parts | (P-1) | 5 parts | None | — |
| Photosensitive member 4 | (Acr-12) | 25 parts | (Acr-22) | 75 parts | (P-1) | 5 parts | None | — |
| Photosensitive member 5 | (Acr-12) | 25 parts | (Acr-23) | 75 parts | (P-1) | 5 parts | None | — |
| Photosensitive member 6 | (Acr-12) | 22.5 parts | (Acr-21) | 67.5 parts | (P-1) | 5 parts | (CTM-21) | 10 parts |
| Photosensitive member 7 | (Acr-12) | 22.5 parts | (Acr-21) | 67.5 parts | (P-1) | 5 parts | None | — |
| Photosensitive member 8 | (Acr-12) | 20 parts | (Acr-21) | 60 parts | (P-1) | 5 parts | (CTM-21) | 10 parts |
| Photosensitive member 9 | (Acr-12) | 23.75 parts | (Acr-21) | 71.25 parts | (P-1) | 5 parts | None | — |
| Photosensitive member 10 | (Acr-12) | 17.5 parts | (Acr-21) | 52.5 parts | (P-1) | 5 parts | None | — |
| Photosensitive member 11 | (Acr-12) | 22.5 parts | (Acr-21) | 67.5 parts | (P-1) | 5 parts | None | — |
| Photosensitive member 12 | (Acr-12) | 22.5 parts | (Acr-21) | 67.5 parts | (P-1) | 5 parts | None | — |

TABLE 1-continued

| | | | | | | | | |
|---|---|---|---|---|---|---|---|---|
| Photosensitive member 13 | (Acr-12) | 22.5 parts | (Acr-21) | 67.5 parts | (P-1) | 5 parts | None | — |
| Photosensitive member 14 | (Acr-12) | 22.5 parts | (Acr-21) | 67.5 parts | (P-1) | 5 parts | None | — |
| Photosensitive member 15 | (Acr-12) | 22.5 parts | (Acr-21) | 67.5 parts | (P-1) | 5 parts | None | — |
| Photosensitive member 16 | (Acr-12) | | (Acr-21) | 67.5 parts | (P-1) | 5 parts | None | — |
| Photosensitive member 17 | (Acr-12) | 23.75 parts | (Acr-21) | 71.25 parts | (P-1) | 5 parts | (CTM-21) | 5 parts |
| Photosensitive member 18 | (Acr-12) | 20 parts | (Acr-21) | 60 parts | (P-1) | 5 parts | (CTM-21) | 20 parts |
| Photosensitive member 19 | (Acr-12) | 25 parts | (Acr-21) | 75 parts | (P-1) | 15 parts | None | — |
| Photosensitive member 20 | (Acr-12) | 25 parts | (Acr-21) | 75 parts | (P-1) | 1 parts | None | — |
| Photosensitive member 21 | (Acr-12) | 10 parts | (Acr-21) | 90 parts | (P-1) | 5 parts | None | — |
| Photosensitive member 22 | (Acr-12) | 25 parts | (Acr-21) | 75 parts | (P-1) | 5 parts | None | — |
| Photosensitive member 23 | (Acr-12) | 25 parts | (Acr-21) | 75 parts | (P-1) | 5 parts | None | — |
| Comparative photosensitive member 1 | (Acr-11) | 50 parts | (Acr-21) | 50 parts | (P-1) | 5 parts | None | — |
| Comparative photosensitive member 2 | (Acr-11) | 25 parts | (Acr-21) | 75 parts | (P-1) | 5 parts | None | — |
| Comparative photosensitive member 3 | (Acr-12) | 25 parts | (Acr-21) | 75 parts | (P-1) | 5 parts | None | — |
| Comparative photosensitive member 4 | (Acr-12) | 25 parts | (Acr-21) | 75 parts | (P-1) | 5 parts | None | — |
| Comparative photosensitive member 5 | (Acr-24) | 90.5 parts | None | — | (P-2) | 5.9 parts | (CTM-27) | 3.6 parts |
| Comparative photosensitive member 6 | (Acr-13) | 50 parts | (Acr-24) | 50 parts | (P-1) | 5 parts | None | — |

| | Electroconductive particles | | | | | | |
|---|---|---|---|---|---|---|---|
| Photosensitive member | Material | Particle diameter D90 | Number of parts | Polishing sheet | Sdr value | A value | B value |
| Photosensitive member 1 | None | — | — | C-2000 | 7.3% | 0.26 | 0.52 |
| Photosensitive member 2 | None | — | — | C-2000 | 7.9% | 0.17 | 0.049 |
| Photosensitive member 3 | None | — | — | C-2000 | 6.7% | 0.15 | 0.047 |
| Photosensitive member 4 | None | — | — | C-2000 | 6.6% | 0.18 | 0.048 |
| Photosensitive member 5 | None | — | — | C-2000 | 6.2% | 0.17 | 0.043 |
| Photosensitive member 6 | None | — | — | C-2000 | 16.0% | 0.19 | 0.055 |
| Photosensitive member 7 | Indium tin oxide | 300 nm | 10 parts | C-2000 | 6.2% | 0.14 | 0.048 |
| Photosensitive member 8 | Indium tin oxide | 300 nm | 10 parts | C-2000 | 9.3% | 0.20 | 0.051 |
| Photosensitive member 9 | Indium tin oxide | 300 nm | 5 parts | C-2000 | 6.4% | 0.15 | 0.047 |
| Photosensitive member 10 | Indium tin oxide | 300 nm | 30 parts | C-2000 | 8.8% | 0.14 | 0.028 |
| Photosensitive member 11 | Aluminum oxide | 250 nm | 10 parts | C-2000 | 7.1% | 0.13 | 0.056 |
| Photosensitive member 12 | Zirconium oxide | 200 nm | 10 parts | C-2000 | 6.5% | 0.14 | 0.055 |
| Photosensitive member 13 | Zinc oxide | 3,500 nm | 10 parts | C-2000 | 7.0% | 0.15 | 0.046 |
| Photosensitive member 14 | Indium oxide | 330 nm | 10 parts | C-2000 | 6.7% | 0.16 | 0.047 |
| Photosensitive member 15 | Lanthanum oxide | 270 nm | 10 parts | C-2000 | 8.1% | 0.15 | 0.051 |
| Photosensitive member 16 | antimony oxide | 190 nm | 10 parts | C-2000 | 9.3% | 0.16 | 0.047 |

TABLE 1-continued

| | | | | | | | |
|---|---|---|---|---|---|---|---|
| Photosensitive member 17 | None | — | — | C-2000 | 10.2% | 0.17 | 0.050 |
| Photosensitive member 18 | None | — | — | C-2000 | 13.5% | 0.23 | 0.059 |
| Photosensitive member 19 | None | — | — | C-2000 | 3.2% | 0.21 | 0.023 |
| Photosensitive member 20 | None | — | — | C-2000 | 17.9% | 0.14 | 0.068 |
| Photosensitive member 21 | None | — | — | C-2000 | 6.7% | 0.11 | 0.047 |
| Photosensitive member 22 | None | — | — | C-8000 | 1.2% | 0.15 | 0.045 |
| Photosensitive member 23 | None | — | — | C-1000 | 38.3% | 0.15 | 0.046 |
| Comparative photosensitive member 1 | None | — | — | None | 0.1% | 0.26 | 0.052 |
| Comparative photosensitive member 2 | None | — | — | None | 0.1% | 0.17 | 0.049 |
| Comparative photosensitive member 3 | None | — | — | None | 0.1% | 0.15 | 0.047 |
| Comparative photosensitive member 4 | None | — | — | C-500 | 43.0% | 0.15 | 0.047 |
| Comparative photosensitive member 5 | None | — | — | C-2000 | 6.7% | 0.08 | 0.051 |
| Comparative photosensitive member 6 | None | — | — | C-2000 | 6.7% | 0.28 | 0.063 |

[Evaluation]

Examples 1 to 35 and Comparative Examples 1 to 6

A reconstructed machine of a laser beam printer available under the product name "HP LaserJet Enterprise Color M553dn" from Hewlett-Packard Company was used as an electrophotographic apparatus. The cleaning blade of the apparatus was replaced with a member whose surface had a dynamic hardness of 0.30 ($mN/\mu m^2$). The intermediate transfer member thereof was replaced with a member whose surface layer resin was an acrylic resin. The ratio D2/D1 of the peripheral speed D2 of the intermediate transfer member to the peripheral speed D1 of the electrophotographic photosensitive member was adjusted to 110%. The ratio D3/D1 of the peripheral speed D3 of the developer-carrying member of the electrophotographic photosensitive member to the peripheral speed D1 of the electrophotographic photosensitive member was adjusted to 110%. The following evaluations were performed by using the apparatus. In addition, in each of Examples 24 to 35, the apparatus was reconstructed as shown in Table 2.

<Sensitivity>

A sensitivity evaluation was performed as described below. First, an applied voltage was adjusted so that the surface of each of the photosensitive members of Examples 1 to 35 and Comparative Examples 1 to 6 had a predetermined potential (Vd: −600 V). Next, the surface of the photosensitive member was charged, and then the surface of the photosensitive member was exposed to light at an exposure value of 0.30 $\mu J/cm^2$. A surface potential at that time was evaluated as the sensitivity of the photosensitive member.

<Image Smearing>

First, the electrophotographic apparatus and each of the photosensitive members were left to stand under an environment at a temperature of 30° C. and a humidity of 80% RH for 24 hours or more. After that, the photosensitive member was mounted on the cyan color cartridge of the electrophotographic apparatus.

Next, a voltage was applied to the photosensitive member while the applied voltage was increased in a stepwise manner from −400 V to −2,000 V in increments of 100 V, followed by the measurement of a total current at each applied voltage. Then, a graph whose axis of abscissa indicated the applied voltage and whose axis of ordinate indicated the total current was produced, and the applied voltage at which a current value deviating from a first-order approximation curve in an applied voltage range between −400 V and −800 V became 100 ρA was determined. Thus, the applied voltage was set.

Next, a solid image was output on A4 size plain paper by using a cyan color alone, and an image exposure light quantity was set so that the density of the image on the paper measured with a spectral densitometer (product name: X-Rite 504, manufactured by X-Rite Inc.) became 1.45.

Next, a square lattice image having a line width of 0.1 mm and a line interval of 10 mm was continuously output on 10,000 sheets of A4 size plain paper by using the cyan color alone. After the image output, the main power source of the electrophotographic apparatus was turned off, and the apparatus was left to stand under the environment at a temperature of 30° C. and a humidity of 80% RH for 3 days. After the standing, the main power source of the electrophotographic apparatus was turned on, and immediately after that, the square lattice image was similarly output on 10 sheets of A4 size plain paper. The image smearing of each of the output images was visually observed, and the image smearing was evaluated by the following criteria. The average of the 10 output images was adopted as an evaluation result.

Evaluation ranks were as described below.

Rank 5: No abnormality is observed in the lattice image.

Rank 4: The horizontal lines of the lattice image break, but no abnormality is observed in the vertical lines thereof.

Rank 3: The horizontal lines of the lattice image disappear, but no abnormality is observed in the vertical lines thereof.

Rank 2: The horizontal lines of the lattice image disappear, and the vertical lines thereof break.

Rank 1: The horizontal lines of the lattice image disappear, and the vertical lines thereof also disappear.

At this time, the horizontal lines in the lattice image refer to lines parallel to the cylindrical axis direction of the photosensitive member, and the vertical lines therein refer to lines perpendicular to the cylindrical axis direction of the photosensitive member.

<Torque>

In the above-mentioned evaluation apparatus, the process cartridge was rotated at 300 mm/sec in a direction counter to the cleaning blade, and the torque of the process cartridge 60 seconds after the rotation was measured.

The above-mentioned evaluation results are shown in Table 2 below.

TABLE 2

| Example | Photosensitive member | Dynamic hardness of surface of cleaning blade (mN/μm$^2$) | Surface layer resin of intermediate transfer member | Ratio of peripheral speed D2 of intermediate transfer member to peripheral speed D1 of electrophotographic photo sensitive member | Ratio of peripheral speed D3 of developer-carrying member to peripheral speed D1 of electrophotographic photosensitive member | Supply of metal soap to photosensitive member in electrophotographic apparatus | Sensitivity [V] | Image smearing | Torque [kg · f/cm] |
|---|---|---|---|---|---|---|---|---|---|
| Example 1 | Photosensitive member 1 | 0.3 | Acrylic resin | 110% | 110% | Absent | 118 | 4.1 | 3.24 |
| Example 2 | Photosensitive member 2 | 0.3 | Acrylic resin | 110% | 110% | Absent | 124 | 4.3 | 3.22 |
| Example 3 | Photosensitive member 3 | 0.3 | Acrylic resin | 110% | 110% | Absent | 129 | 4.3 | 3.27 |
| Example 4 | Photosensitive member 4 | 0.3 | Acrylic resin | 110% | 110% | Absent | 131 | 4.1 | 3.27 |
| Example 5 | Photosensitive member 5 | 0.3 | Acrylic resin | 110% | 110% | Absent | 130 | 4.2 | 3.28 |
| Example 6 | Photosensitive member 6 | 0.3 | Acrylic resin | 110% | 110% | Absent | 116 | 4.5 | 2.94 |
| Example 7 | Photosensitive member 7 | 0.3 | Acrylic resin | 110% | 110% | Absent | 142 | 4.5 | 3.28 |
| Example 8 | Photosensitive member 8 | 0.3 | Acrylic resin | 110% | 110% | Absent | 120 | 4.9 | 3.17 |
| Example 9 | Photosensitive member 9 | 0.3 | Acrylic resin | 110% | 110% | Absent | 149 | 4.5 | 3.28 |
| Example 10 | Photosensitive member 10 | 0.3 | Acrylic resin | 110% | 110% | Absent | 141 | 4.8 | 3.19 |
| Example 11 | Photosensitive member 11 | 0.3 | Acrylic resin | 110% | 110% | Absent | 146 | 4.5 | 3.25 |
| Example 12 | Photosensitive member 12 | 0.3 | Acrylic resin | 110% | 110% | Absent | 142 | 4.5 | 3.27 |
| Example 13 | Photosensitive member 13 | 0.3 | Acrylic resin | 110% | 110% | Absent | 143 | 4.3 | 3.26 |
| Example 14 | Photosensitive member 14 | 0.3 | Acrylic resin | 110% | 110% | Absent | 146 | 4.5 | 3.27 |
| Example 15 | Photosensitive member 15 | 0.3 | Acrylic resin | 110% | 110% | Absent | 145 | 4.6 | 3.22 |
| Example 16 | Photosensitive member 16 | 0.3 | Acrylic resin | 110% | 110% | Absent | 141 | 4.6 | 3.17 |
| Example 17 | Photosensitive member 17 | 0.3 | Acrylic resin | 110% | 110% | Absent | 123 | 4.5 | 3.14 |
| Example 18 | Photosensitive member 18 | 0.3 | Acrylic resin | 110% | 110% | Absent | 111 | 4.6 | 3.03 |
| Example 19 | Photosensitive member 19 | 0.3 | Acrylic resin | 110% | 110% | Absent | 131 | 4.2 | 3.39 |
| Example 20 | Photosensitive member 20 | 0.3 | Acrylic resin | 110% | 110% | Absent | 134 | 4.3 | 2.87 |
| Example 21 | Photosensitive member 21 | 0.3 | Acrylic resin | 110% | 110% | Absent | 139 | 4.0 | 3.27 |
| Example 22 | Photosensitive member 22 | 0.3 | Acrylic resin | 110% | 110% | Absent | 129 | 4.3 | 3.46 |
| Example 23 | Photosensitive member 23 | 0.3 | Acrylic resin | 110% | 110% | Absent | 132 | 4.0 | 2.16 |
| Example 24 | Photosensitive member 3 | 0.3 | Acrylic resin | 110% | 110% | Present | 130 | 5.0 | 2.37 |
| Example 25 | Photosensitive member 3 | 0.3 | Acrylic resin | 110% | 80% | Absent | 131 | 4.1 | 3.36 |
| Example 26 | Photosensitive member 3 | 0.3 | Acrylic resin | 110% | 120% | Absent | 132 | 4.3 | 3.30 |

TABLE 2-continued

| Example | Photosensitive member | Dynamic hardness of surface of cleaning blade (mN/μm$^2$) | Surface layer resin of intermediate transfer member | Ratio of peripheral speed D2 of intermediate transfer member to peripheral speed D1 of electrophotographic photo sensitive member | Ratio of peripheral speed D3 of developer-carrying member to peripheral speed D1 of electrophotographic photosensitive member | Supply of metal soap to photosensitive member in electrophotographic apparatus | Sensitivity [V] | Image smearing | Torque [kg · f/cm] |
|---|---|---|---|---|---|---|---|---|---|
| Example 27 | Photosensitive member 3 | 0.3 | Acrylic resin | 110% | 70% | Absent | 130 | 4.4 | 3.41 |
| Example 28 | Photosensitive member 3 | 0.3 | Acrylic resin | 110% | 130% | Absent | 132 | 4.2 | 3.33 |
| Example 29 | Photosensitive member 3 | 0.3 | Acrylic resin | 101% | 110% | Absent | 133 | 4.1 | 3.09 |
| Example 30 | Photosensitive member 3 | 0.3 | Acrylic resin | 120% | 110% | Absent | 130 | 4.2 | 3.39 |
| Example 31 | Photosensitive member 3 | 0.3 | Acrylic resin | 90% | 110% | Absent | 131 | 4.1 | 3.40 |
| Example 32 | Photosensitive member 3 | 0.3 | Acrylic resin | 130% | 110% | Absent | 129 | 4.3 | 3.46 |
| Example 33 | Photosensitive member3 | 0.3 | Polyurethane resin | 110% | 110% | Absent | 128 | 3.9 | 3.65 |
| Example 34 | Photosensitive member3 | 0.06 | Acrylic resin | 110% | 110% | Absent | 130 | 4.3 | 3.98 |
| Example 35 | Photosensitive member3 | 0.6 | Acrylic resin | 110% | 110% | Absent | 131 | 4.0 | 2.99 |
| Comparative Example 1 | Comparative photosensitive member 1 | 0.3 | Acrylic resin | 110% | 110% | Absent | 118 | 3.1 | 4.82 |
| Comparative Example 2 | Comparative photosensitive member 2 | 0.3 | Acrylic resin | 110% | 110% | Absent | 124 | 3.0 | 4.79 |
| Comparative Example 3 | Comparative photosensitive member 3 | 0.3 | Acrylic resin | 110% | 110% | Absent | 129 | 3.3 | 4.88 |
| Comparative Example 4 | Comparative photosensitive member 4 | 0.3 | Acrylic resin | 110% | 110% | Absent | 145 | 1.3 | 2.00 |
| Comparative Example 5 | Comparative photosensitive member 5 | 0.3 | Acrylic resin | 110% | 110% | Absent | 312 | 3.5 | 3.27 |
| Comparative Example 6 | Comparative photosensitive member 6 | 0.3 | Acrylic resin | 110% | 110% | Absent | 136 | 1.1 | 3.27 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2021-032147, filed Mar. 1, 2021 which is hereby incorporated by reference herein in its entirety.

What is claimed is:

1. An electrophotographic photosensitive member comprising, in this order:

a support;

a photosensitive layer; and a protection layer as a surface layer, wherein the protection layer has a surface having a developed area ratio Sdr of 1.0% to 40.0%, and wherein an A value represented by formula (1) of 0.10 to 0.27:

$$A=S1/S2 \quad \text{formula (1)}$$

where, in the formula (1), S1 represents a peak area from 1,530 cm$^{-1}$ to 1,470 cm$^{-1}$ based on C═C stretching vibration of an aromatic ring out of peak areas of a spectrum obtained by subjecting the surface of the protection layer to measurement by attenuated total reflection Fourier transform infrared spectroscopy through use of Ge as an internal reflection element and through use of a measurement condition of 45° as an angle of incidence, and S2 represents a peak area from 1,770 cm$^{-1}$ to 1,700 cm$^{-1}$ based on C═O stretching vibration of an ester group out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

2. The electrophotographic photosensitive member according to claim 1, wherein the surface of the protection layer has a B value represented by formula (2) of 0.005 to 0.070:

$$B=S3/S2 \quad \text{formula (2)}$$

where, in the formula (2), S2 is identical in meaning to the S2 in the formula (1), and represents the peak area based on the C═O stretching vibration of the ester group, and S3 represents a peak area from 1,413 $cm^{-1}$ to 1,400 $cm^{-1}$ based on in-plane deformation vibration of a terminal olefin ($CH_2$═) out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

3. The electrophotographic photosensitive member according to claim 1, wherein the protection layer comprises an unsubstituted cyclohexane skeleton and/or a cyclohexane skeleton having a substituent.

4. The electrophotographic photosensitive member according to claim 1, wherein the protection layer comprises a triarylamine compound which is free of a curable functional group, in a content of 5 mass % to 50 mass % with respect to a total mass of the protection layer.

5. The electrophotographic photosensitive member according to claim 1, wherein the protection layer comprises electroconductive particles, in a content of 5 mass % to 30 mass % with respect to a total mass of the protection layer, and the electroconductive particles are particles of at least one selected from the group consisting of indium tin oxide, aluminum oxide, zirconium oxide, zinc oxide, indium oxide, lanthanum oxide, and tin antimony oxide.

6. A process cartridge comprising:

an electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus, wherein the electrophotographic photosensitive member comprises, in this order: a support; a photosensitive layer; and a protection layer as a surface layer, wherein the protection layer has a surface having a developed area ratio Sdr of 1.0% to 40.0%, and an A value represented by formula (1) of 0.10 to 0.27:

$$A = S1/S2 \quad \text{formula (1)}$$

where, in the formula (1), S1 represents a peak area from 1,530 $cm^{-1}$ to 1,470 $cm^{-1}$ based on C═C stretching vibration of an aromatic ring out of peak areas of a spectrum obtained by subjecting the surface of the protection layer to measurement by attenuated total reflection Fourier transform infrared spectroscopy through use of Ge as an internal reflection element and through use of a measurement condition of 45° as an angle of incidence, and S2 represents a peak area from 1,770 $cm^{-1}$ to 1,700 $cm^{-1}$ based on C═O stretching vibration of an ester group out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

7. The process cartridge according to claim 6, wherein the cleaning unit is formed of a cleaning blade, and a surface of the cleaning blade has a dynamic hardness of 0.06 to 0.60 ($mN/\mu m^2$).

8. The process cartridge according to claim 6, wherein the protection layer is a cured film obtained by polymerizing a composition containing a monomer having a polymerizable functional group, and the composition contains, as the monomer, a compound represented by the following formula (Acr-11) and a compound represented by the following formula (Acr-21):

(Acr-11)

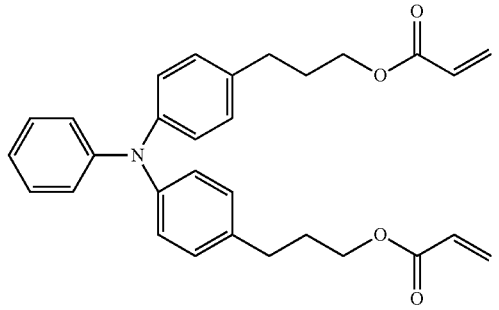

and (Acr-21)

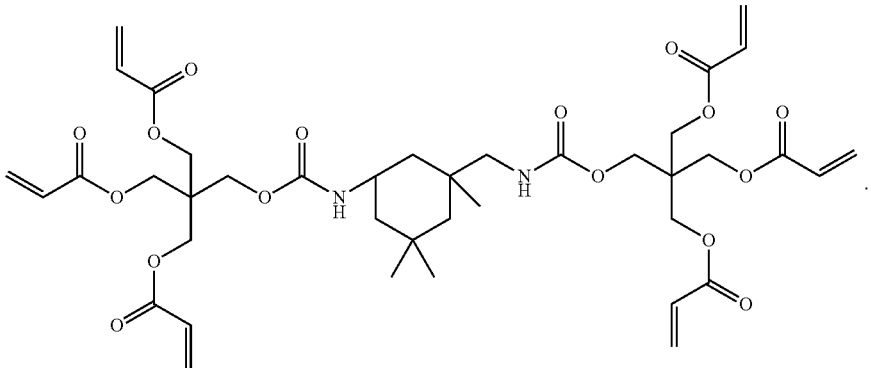

9. The process cartridge according to claim 8, wherein the surface of the protection layer has a B value represented by formula (2) of 0.005 to 0.070:

B=S3/S2 formula (2)

where, in the formula (2), S2 is identical in meaning to the S2 in the formula (1), and represents the peak area based on the C═O stretching vibration of the ester group, and S3 represents a peak area from 1,413 $cm^{-1}$ to 1,400 $cm^{-1}$ based on in-plane deformation vibration of a terminal olefin ($CH_2$═) out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

10. An electrophotographic apparatus comprising:

an electrophotographic photosensitive member; and a charging unit, an exposing unit, a developing unit, and a transferring unit, wherein the electrophotographic photosensitive member comprises, in this order: a support; a photosensitive layer; and a protection layer as a surface layer, wherein the protection layer has a surface having a developed area ratio Sdr of 1.0% to 40.0%, and an A value represented by formula (1) of 0.10 to 0.27:

$$A=S1/S2 \quad \text{formula (1)}$$

where, in the formula (1), S1 represents a peak area from 1,530 $cm^{-1}$ to 1,470 $cm^{-1}$ based on C═C stretching vibration of an aromatic ring out of peak areas of a spectrum obtained by subjecting the surface of the protection layer to measurement by attenuated total reflection Fourier transform infrared spectroscopy through use of Ge as an internal reflection element and through use of a measurement condition of 45° as an angle of incidence, and S2 represents a peak area from 1,770 $cm^{-1}$ to 1,700 $cm^{-1}$ based on C═O stretching vibration of an ester group out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

11. The electrophotographic apparatus according to claim 10, wherein the transferring unit comprises an intermediate transfer member having a surface layer comprising an acrylic resin.

12. The electrophotographic apparatus according to claim 10, wherein the transferring unit comprises an intermediate transfer member, and a peripheral speed ratio of a peripheral speed D2 of the intermediate transfer member to a peripheral speed D1 of the electrophotographic photosensitive member falls within a range represented by formula (4)

$$101\% \leq D2/D1 \leq 120\% \quad \text{formula (4).}$$

13. The electrophotographic apparatus according to claim 10, wherein the developing unit comprises a developer-carrying member, and a peripheral speed ratio of a peripheral speed D3 of the developer-carrying member to a peripheral speed D1 of the electrophotographic photosensitive member falls within a range represented by formula (5)

$$80\% \leq D3/D1 \leq 120\% \quad \text{formula (5).}$$

14. The electrophotographic apparatus according to claim 10, wherein the electrophotographic apparatus further comprises a lubricant-supplying unit for supplying a lubricant to the surface of the electrophotographic photosensitive member, the lubricant-supplying unit holding the lubricant.

15. The electrophotographic apparatus according to claim 10, wherein the protection layer is a cured film obtained by polymerizing a composition containing a monomer having a polymerizable functional group, and the composition contains, as the monomer, a compound represented by the following formula (Acr-11) and a compound represented by the following formula (Acr-21):

(Acr-11)

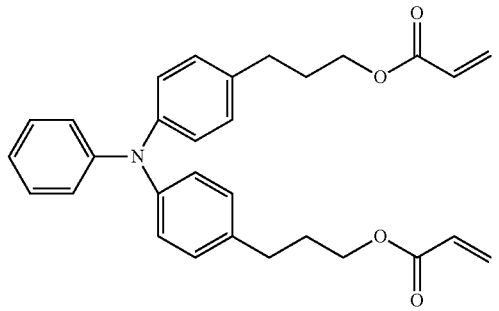

and (Acr-21)

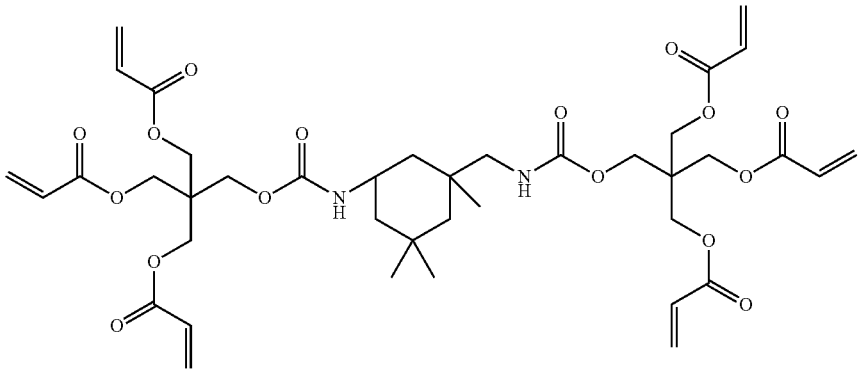

16. The electrophotographic apparatus according to claim 15, wherein the surface of the protection layer has a B value represented by formula (2) of 0.005 to 0.070:

$$B=S3/S2 \quad \text{formula (2)}$$

where, in the formula (2), S2 is identical in meaning to the S2 in the formula (1), and represents the peak area based on the C═O stretching vibration of the ester group, and S3 represents a peak area from 1,413 $cm^{-1}$ to 1,400 $cm^{-1}$ based on in-plane deformation vibration of a terminal olefin ($CH_2$═) out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

17. An electrophotographic photosensitive member comprising, in this order:

a support;

a photosensitive layer; and a protection layer as a surface layer, wherein the protection layer is a cured film obtained by polymerizing a composition containing a monomer having a polymerizable functional group, the protection layer has a surface having a developed area ratio Sdr of 1.0% to 40.0% or less, and wherein an A value represented by formula (1) of 0.10 to 0.27:

$$A=S1/S2 \quad \text{formula (1)}$$

where, in the formula (1), S1 represents a peak area from 1,530 $cm^{-1}$ to 1,470 $cm^{-1}$ based on C═C stretching vibration of an aromatic ring out of peak areas of a spectrum obtained by subjecting the surface of the protection layer to measurement by attenuated total reflection Fourier transform infrared spectroscopy through use of Ge as an internal reflection element and through use of a measurement condition of 45° as an angle of incidence, and S2 represents a peak area from 1,770 $cm^{-1}$ to 1,700 $cm^{-1}$ based on C═O stretching vibration of an ester group out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

18. The electrophotographic photosensitive member according to claim 17, wherein the composition contains, as the monomer, a compound represented by the following formula (Acr-11) and a compound represented by the following formula (Acr-21):

(Acr-11)

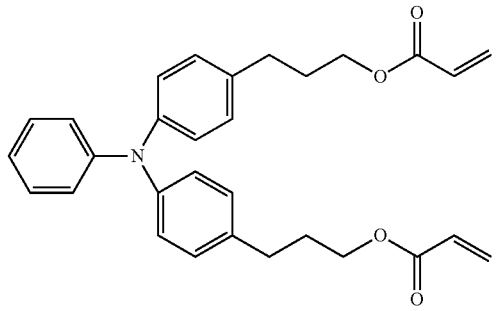

and (Acr-21)

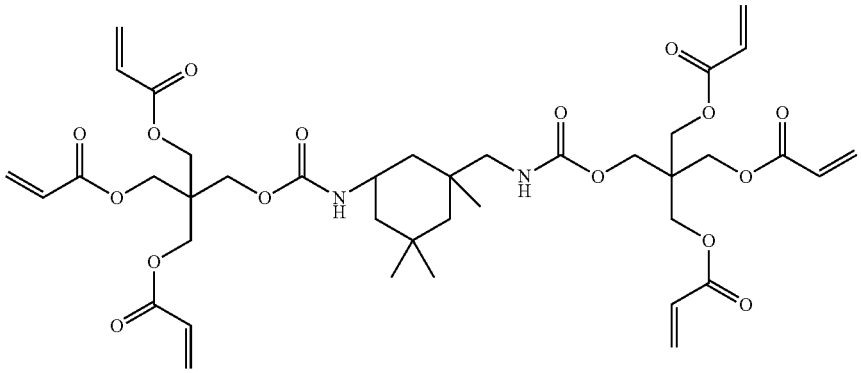

19. The electrophotographic photosensitive member according to claim 18, wherein the surface of the protection layer has a B value represented by formula (2) of 0.005 to 0.070:

$$B=S3/S2 \qquad \text{formula (2)}$$

where, in the formula (2), S2 is identical in meaning to the S2 in the formula (1), and represents the peak area based on the C═O stretching vibration of the ester group, and S3 represents a peak area from 1,413 $cm^{-1}$ to 1,400 $cm^{-1}$ based on in-plane deformation vibration of a terminal olefin ($CH_2$═) out of the peak areas of the spectrum obtained by subjecting the surface of the protection layer to the measurement by the attenuated total reflection Fourier transform infrared spectroscopy through use of Ge as the internal reflection element and through use of a measurement condition of 45° as the angle of incidence.

* * * * *